US005258274A

United States Patent [19]

Helland et al.

[11] Patent Number: 5,258,274

[45] Date of Patent: Nov. 2, 1993

[54] THERMAL DYE BLEACH CONSTRUCTION SENSITIVE TO ULTRAVIOLET RADIATION

[75] Inventors: Randall H. Helland, Maplewood; George V. D. Tiers, St. Paul, both of Minn.; Dian E. Stevenson, Sawbridgeworth, England

[73] Assignee: Minnesota Mining and Manufacturing Company, St. Paul, Minn.

[21] Appl. No.: 887,778

[22] Filed: May 22, 1992

[51] Int. Cl.[5] ..... G03C 1/825

[52] U.S. Cl. ..... 430/522; 430/334; 430/339; 430/512; 430/617; 430/955; 430/964; 503/227

[58] Field of Search ..... 430/334, 339, 512, 572, 430/617, 964, 955, 580, 594; 503/227

[56] References Cited

U.S. PATENT DOCUMENTS

| | | | |
|---|---|---|---|
| 3,384,487 | 5/1968 | Heseltine et al. | 430/522 |
| 3,481,927 | 12/1969 | Heseltine et al. | 430/522 |
| 3,684,552 | 8/1972 | Wiese et al. | 117/36.8 |
| 3,769,019 | 10/1973 | Wiese et al. | 96/84 |
| 4,060,420 | 11/1977 | Merkel et al. | 430/490 |
| 4,668,615 | 5/1987 | Kawata et al. | 430/955 |
| 4,705,737 | 11/1987 | Hirai et al. | 430/955 |
| 5,135,842 | 8/1992 | Kitchin et al. | 430/510 |

*Primary Examiner*—Charles L. Bowers, Jr.
*Assistant Examiner*—J. Pasterczyk
*Attorney, Agent, or Firm*—Gary L. Griswold; Walter N. Kirn; Mark A. Litman

[57] ABSTRACT

A thermal-dye-bleach construction comprising a thermal nucleophile-generating agent in association with a styryl dye having a nucleus of general formula (I):

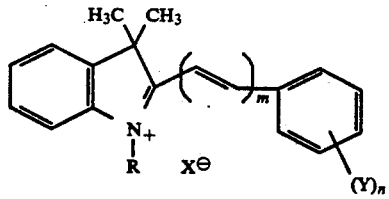

representing the nucleus of a styryl dye in which
R=methyl or ethyl group
Y=alkoxy of 1 to 20 carbon atoms
m=1 or 2,
n=1, 2, or 3, and
x⊖=an anion The aromatic fused benzene portion of the indolenine ring may be further substituted with commonly acceptable dye substituents such as alkyl and substituted alkyl (of 1 to 10 carbon atoms) groups, alkoxy groups (preferably of 1 to 10 carbon atoms), fused aromatic rings (as to make the benzene ring a fused naphthalene ring), halogen (including fluoro), cyano, nitro, carboxamido, amido, etc. One or two substituents chosen variously from said group may also be present on the phenyl ring to which the alkoxy group is attached. These substituents and their combinations should not be chosen so as to alter the absorption characteristics of the dye greatly enough to remove the maximum absorption from between 300 and 490 nm. X⊖ may be any anion, but certain classes of anions and certain particular anions are preferred. Aromatic and perfluorinated anions and, in particular dodecylbenzenesulfonate and especially perfluoro(ethylcyclohexane sulfonate) are preferred on account of their solubilizing power, but simpler anions such as iodide, chloride, bromide, methylsulfate, perchlorate and the like may also be used.

17 Claims, No Drawings

THERMAL DYE BLEACH CONSTRUCTION SENSITIVE TO ULTRAVIOLET RADIATION

FIELD OF THE INVENTION

This invention relates to a thermal-dye-bleach system and in particular to a thermal-dye-bleach system comprising a narrow class of styryl dyes and a thermal nucleophile generating agent, and the use of the system in photographic materials.

BACKGROUND OF THE INVENTION

The increasing availability and use of focused or laser light sources and particularly lasers which emit in the ultraviolet and blue region of the electromagnetic spectrum has led to a need for high quality photographic materials which are sensitive in this region, especially from 300 nm to 490 nm.

In order to improve the image sharpness of photographic materials it is customary to incorporate a dye in one or more layers of the material, the purpose of which is to absorb light that has been scattered within the coating and would otherwise lead to reduced image sharpness. Dyes used for this purpose are known as antihalation dyes if incorporated in a separate backing layer or underlayer and as acutance dyes if incorporated into the light sensitive layer itself.

It is usually essential that antihalation or acutance dyes should completely decolorize under the processing conditions of the photographic material concerned. In the case of photothermographic materials which are processed by simply heating for a short period of time at temperatures usually between 100° C. and 200° C., any antihalation or acutance dyes used must decolorize thermally.

Various thermal-dye-bleach systems are known in the prior art including single compounds which spontaneously decompose and decolorize at elevated temperature and combinations of dye and thermal dye bleaching agent which together form a thermal-dye-bleach system.

U.S. Pat. Nos. 3,609,360, 3,619,194, 3,627,527, 3,684,552, 3,852,093, 4,033,948, 4,088,497, 4,196,002, 4,197,131, 4,201,590 and 4,283,487 disclose various thermal-dye-bleach systems which absorb principally in the visible region of the electromagnetic spectrum and the near-infrared region.

A variety of thermal base-generating agents are known and have been used in photothermographic materials. However, in most cases in which thermal base-releasing agents have been incorporated into photothermographic constructions in the prior art, the purpose has been to increase the alkalinity of the medium during thermal processing and to promote the development reaction. Thermal base-releasing agents have been used thus in photothermographic materials of both the diazo type and silver based materials.

U.S. Pat. No. 4,370,401 uses nitrate salts to bleach dyes of a different structure than the dyes of this invention, but including at least one styryl dye. Also it was found that bleaching of this nitrate system was seriously inhibited in the cellulose-acetate-butyrate binder system required to achieve acceptable adhesion to polyester.

SUMMARY OF THE INVENTION

It has now been found that certain (blue-absorbing) yellow and UV-absorbing alkoxy substituted styryl dyes will substantially or completely bleach upon heating in the presence of thermal nucleophile-generating agents.

According to the present invention there is provided a thermal-dye-bleach construction comprising a thermal nucleophile-generating agent in association with a class of alkoxy styryl dyes having a nucleus of general formula (I):

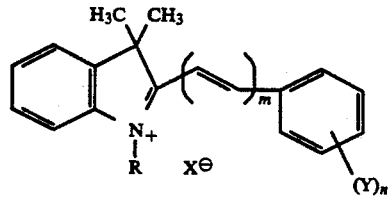

representing the nucleus of a styryl dye in which

R=alkyl groups of 1 to 20 and preferably 1 to 5 carbon atoms such as methyl or ethyl group, Y=alkoxy of 1 to 20 carbon atoms, preferably of 1 to 10 carbon atoms, m=1 or 2, n=1, 2, or 3, and XΘ=an anion The aromatic fused benzene portion of the indolenine ring system may be further substituted with commonly acceptable dye substituents such as alkyl and substituted alkyl groups (of 1 to 10 carbon atoms), alkoxy groups (preferably of 1 to 10 carbon atoms), fused aromatic rings (as to make the benzene ring a fused naphthalene ring), halogen (including fluoro), cyano, nitro, carboxamido, amido, etc. One or two substituents chosen variously from said substituent may also be present on the phenyl ring to which the alkoxy group is attached. These substituents and their combinations should not be chosen so as to alter the absorption characteristics of the dye greatly enough to remove the wavelength of maximum absorption (λmax) from between 300 and 490 nm.

XΘ may be any anion, but certain classes of anions and certain particular anions are preferred. Aromatic and perfluorinated anions and, in particular dodecylbenzenesulfonate and especially perfluoro(ethylcyclohexane sulfonate) are preferred on account of their solubilizing power, but simpler anions such as iodide, chloride, bromide, methylsulfate, perchlorate and the like may also be used.

DETAILED DESCRIPTION OF THE INVENTION

The combination of the styryl dye, which is an ultraviolet to blue absorbing dye (300 to 490 nm), with a thermal nucleophile-generating agent, e.g., a thermal amine-generating agent, finds particular utility as an antihalation or acutance combination in photothermographic mater . e.g., dry silver materials, since the dyes will readily bleach during the thermal processing of the materials.

A wide variety of thermal nucleophile-generating agents may be used for the purpose of this invention but a preferred embodiment utilizes a thermal amine-generating agent, for example an amine salt of an organic acid which is decarboxylated upon heating to yield the free amine. Preferably the free amine should be a primary or secondary amine.

Compounds of this type are disclosed, for example, in U.S. Pat. Nos. 3,220,846, 4,060,420 and 4,731,321. Japanese Patent Application No. 1-150575 discloses thermally-releasable bis-amines in the form of their bis(aryl sulfonylacetic acid)salts. Other amine-generating compounds include 2-carboxycarboxamide derivatives disclosed in U.S. Pat. No. 4,088,469, hydroxime carbamates disclosed in U.S. Pat. No. 4,511,650 and aldoxime carbamates disclosed in U.S. Pat. No. 4,499,180. All of these agents are described in Applicant's Assignee's copending U.S. Ser. No. 07/529,333 filed May 25, 1990.

Suitable anions for $X^{\ominus}$ may also include organic anions such as those containing a sulfonyl group as the ionic determinant, for example, trifluoromethane-sulfonate and 4-toluene sulfonate.

Representative thermal nucleophile-generating agents are shown in Table III. Representative cations are designated $C_1$–$C_5$ and representative anions are designated $A_1$–$A_6$.

Addition of acid to the thermographic solution is beneficial. Acid retards pre-bleaching of the dye prior to coating, during coating, and in the drying ovens; and results in longer solution pot-life, higher $D_{max}$ and improved shelf life of the thermally bleachable coatings. The acid may be added to the polymer solution directly or may be generated in situ. Phenylsulfonyl acetic acids, and particularly phenylsulfonyl acetic acids having strongly electron withdrawing groups on the phenyl ring are preferred. Representative acids are acids corresponding to acidification (i.e., protonation) of anions $A_1$–$A_6$. In practice use of the free acid of the anion used in the thermal nucleophile generating salt is convenient. As shown in Experiments 1–12 below, the $D_{max}$ of the solutions prepared with acid stabilizer are higher than those of the solutions prepared without acid stabilizer.

The molar ratio of amine-generator to acid is not unduly critical, but usually an excess of amine-generator is used. A mole ratio of between 3/1 to about 5/1 is preferred.

The molar ratio of dye to acid is not particularly critical, but usually a slight excess of dye is present. A ratio from about 1/1 to 2/1 is preferred.

The molar ratio of amine-generator to dye is not particularly critical, but it is important that the amount of amine-generator be greater than the amount of dye. A ratio from about 3/1 to about 5/1 is preferred.

For the purpose of the invention the dye of structure (I) and the thermal amine-generating agent are usually coated together with an organic binder as a thin layer on a base support. The 'association' of the dye and amine-generating agent required in this invention is merely such physical association in the same or adjacent layers that the generated amine is capable of migrating to the dye or reacting with the dye without migration.

The heat bleachable construction thus formed may be used as an antihalation coating for photothermography or it may be used directly as a thermographic material.

For antihalation purposes such a dye/amine generator composite may be present in a layer separate from the photothermographic material either above or below the thermographic material. In the case of transparent supports the antihalation construction may be positioned on the surface of the support opposite the photothermographic material.

A wide variety of polymers are suitable for use as the binder in the heat bleachable construction. The activity of the thermal-dye-bleach layer may be adjusted by suitable choice of polymeric binder. In general, polymeric binders of lower glass transition temperatures produce more active thermal-dye-bleach constructions, but provide less shelf stability.

Thermal-dye-bleach layers with a wide variety of decolorization temperatures may be prepared by suitable choice of polymeric binder.

The dyes are generally included in antihalation layers to provide a transmissive optical density of greater than 0.1 at λmax of the dye. Generally the coating weight of dye which will provide the desired effect is from 0.1 to 1.0 mg/dm$^2$.

The type of photothermographic medium used in the invention is not critical. Examples of suitable photothermographic media include dry silver systems (e.g., U.S. Pat. No. 3,457,075) and diazo systems.

The photothermographic dry silver emulsions of this invention may be constructed of one or more layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and some of the other ingredients in the second layer or both layers. Multicolor photothermographic dry silver constructions contain sets of these bilayers for each color. Color forming layers are maintained distinct from each other by the use of functional or non-functional barrier layers between the various photosensitive layers as described in U.S. Pat. No. 4,460,681.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material constitutes from about 5 to 30 percent by weight of the imaging layer. The second layer in a two-layer construction or in the bilayer of a multi-color construction would not affect the percentage of the silver source material desired in the photosensitive single imaging layer.

The organic silver salt which can be used in the present invention is a silver salt which is comparatively stable to light, but forms a silver image when heated to 80° C. or higher in the presence of a light-exposed photocatalyst (such as silver halide) and a reducing agent.

Suitable organic silver salts include silver salts of organic compounds having a carboxy group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linoleate, silver butyrate and silver camphorate, mixtures thereof, etc. Silver salts which are substituted with a halogen atom or a hydroxyl group can also be effectively used. Preferred examples of the silver salts of aromatic carboxylic acids and other carboxyl group-containing compounds include silver benzoate, a substituted benzoate of silver such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and a silver salt of an aliphatic carboxylic acid containing a thioether group as described in U.S. Pat. No. 3,330,663, etc.

Silver salts of compounds containing mercapto or thione groups and derivatives thereof can be used. Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(S-ethylglycolamido) benzothiazole, a silver salt of thioglycolic acid such as a silver salt of a S-alkyl thioglycolic acid (wherein the alkyl group has from 12 to 22 carbon atoms) as described in Japanese patent application No. 28221/73, a silver salt of a dithiocarboxylic acid such as a silver salt of dithioacetic acid, a silver salt of a thioamide, a silver salt of 5-carboxyl-1-methyl-2-phenyl-4-pyridine, a silver salt of a mercaptotriazine, a silver salt of 2-mercaptobenzoxazole, a silver salt as described in U.S. Pat. No. 4,123,274, for example, a silver salt of a 1,2,4-mercaptotriazole derivative such as a silver salt of 3-amino-5-benzylthio-1,2,4-triazole, a silver salt of 2-thione compound such as a silver salt of 3-(2-carboxyethyl)-4-methyl-4-thiazoline-2-thione as disclosed in U.S. Pat. No. 3,301,678.

Furthermore, a silver salt of a compound containing an imino group can be used. Preferred examples of these compounds include a silver salt of benzotriazole and a derivative thereof as described in Japanese patent publications Nos. 30270/69 and 18146/70, for example, a silver salt of benzotriazole such as a silver salt of methylbenzotriazole, etc., a silver salt of a halogen substituted benzotriazole, such as a silver salt of 5-chlorobenzotriazole, etc., a silver salt of carboimidobenzotriazole, etc., a silver salt of 1,2,4-triazole, of 1-H-tetrazole as described in U.S. Pat. No. 4,220,709, a silver salt of imidazole and an imidazole derivative, and the like.

It is also found convenient to use silver "halfsoaps", of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate "full soap", containing not more than about four or five percent of free behenic acid and analyzing about 25.2 percent silver may be used.

The method used for making silver soap dispersions is well known in the art and is disclosed in Research Disclosure April 1983 (22812), ibid October 1983 (23419), and U.S. Pat. No. 3,985,565.

The light-sensitive silver halide used in the present invention can be employed in a range of 0.0005 mol to 1.0 mol and, preferably, from 0.005 mol to 0.2 mol, and more preferably from 0.008 to 0.15 mol per mol of organic silver salt.

The silver halide may be any photosensitive silver halide such as silver bromide, silver iodide, silver chloride, silver bromoiodide, silver chlorobromoiodide, silver chlorobromide, etc.

The silver halide used in the present invention may be employed without modification. However, it may be chemically sensitized with a chemical sensitizing agent such as a compound containing sulfur, selenium or tellurium etc., or a compound containing gold, platinum, palladium, rhodium or iridium, etc., a reducing agent such as a tin halide, etc., or a combination thereof. The details of these procedures are described in T. H. James "The Theory of the Photographic Process", Fourth Edition, Chapter 5, pages 49 to 169.

The silver halide may be added to the emulsion layer in any fashion which places it in catalytic proximity to the aforementioned organic silver salt.

The silver halide and the organic silver salt which are separately formed in a binder may be mixed prior to use to prepare a coating solution, but it is also effective to blend both of them in a ball mill for a period of time. Further, it is effective to use a process which comprises adding a halogen-containing compound to the prepared organic silver salt to partially convert the silver of the organic silver salt to silver halide.

Methods of preparing these silver halide and organic silver salts and manners of blending them are described in Research Disclosure No. 170-29, Japanese Patent Applications Nos. 32928/75 and 42529/76, U.S. Pat. No. 3,700,458, and Japanese Patent Applications Nos. 13224/74 and 17216/75.

The preformed silver halide emulsions of this invention can be "unwashed" or washed to remove soluble salts. In the latter case the soluble salts can be removed by leaching or the emulsion can be coagulation washed, e.g., by the procedures described in Hewitson, et al., U.S. Pat. No. 2,618,556; Yutzy et al., U.S. Pat. No. 2,614,928; Yackel, U.S. Pat. No. 2,565,418;; Hart et al., U.S. Pat. No. 3,241,969; and Waller et al., U.S. Pat. No. 2,489,341. The silver halide grains may have any crystalline habit including but not limited to cubic, tetrahedral, orthorhombic, tabular, laminar, platelet, etc.

Photothermographic emulsions containing preformed silver halide in accordance with this invention can be sensitized with chemical sensitizers, such as with reducing agents; sulfur, selenium or tellurium compounds; gold, platinum or palladium compounds, or combinations of these. Suitable chemical sensitization procedures are described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The light-sensitive silver halides can be spectrally sensitized with various known dyes including cyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid groups, such as a thiohydantoin nucleus, a rhodanine nucleus, an oxazolidinedione nucleus, a thiazolidinedione nucleus, a barbituric acid nucleus, a thiazolinone nucleus, a malononitrile moiety and a pyrazolone nucleus. In the above described cyanine and merocyanine dyes, those having imino groups or carboxyl groups are particularly effective. Practically, the sensitizing dye to be used in the present invention is properly selected from known dyes as described in U.S. Pat. Nos. 3,761,279, 3,719,495 and 3,877,943, British Patent Nos. 1,466,201, 1,469,117 and 1,422,057, Japanese Patent Application (OPI) Nos. 27924/76 and 156424/75, and so on, and can be located in the vicinity of the photocatalyst according to known methods used in the above-described examples. These spectral sensitizing dyes are used in amounts of about $10^{-4}$ mol to about 0.1 mol per 1 mol of photocatalyst.

The reducing agent for silver ion may be any material, preferably organic material, which will upon silver metal catalysis reduce silver ion to metallic silver. Conventional photographic developers such as phenidone, hydroquinones, and catechol are useful but hindered phenol reducing agents are preferred. The reducing agent should be present as 1 to 10 percent by weight of the imaging layer. In a two-layer construction, if the reducing agent is in the second layer, slightly higher proportions of from about 2 to 15 percent tend to be more desirable.

A wide range of reducing agents have been disclosed in dry silver systems including amidoximes such as phenylamidoxime, 2-thienylamidoxime and p-phenoxyphenylamidoxime, azine, e.g., 4-hydroxy-3,5-dimethoxybenzaldehyde azine; a combination of aliphatic carboxylic acid aryl hydrazides and ascorbic acid, such as 2,2-bis(hydroxymethyl)propionyl-beta-phenyl hydrazide in combination with ascorbic acid; a combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenyl hydrazine, hydroxamic acids such as phenylhydroxamic acid, p-hydroxyphenyl hydroxamic acid, and beta-alanine hydroxamic acid; a combination of azines and sulfonamidophenols, e.g., phenothiazine and 2,6-dichloro-4-benzenesulfonamidophenol; alphacyanophenylacetic acid derivatives such as ethyl-alphacyano-2-methylphenylacetate, ethyl alphacyanophenylacetate; bis-beta-naphthols as illustrated by 2,2'-dihydroxy-1,1'-binaphthyl, 6,6'-dibromo-2,2'-dihydroxy-1,1'-binaphthyl, and bis(2-hydroxy-1-naphthyl)methane; a combination of bis-beta-naphthol and a 1,3-dihydroxybenzene derivative, e.g., 2,4-dihydroxybenzophenone or 2'4'-dihydroxyacetophenone; 5-pyrazolones such as 3-methyl-1-phenyl-5-pyrazolone; reductones as illustrated by dimethylamino hexose reductone, anhydro dihydro amino hexose reductone, and anhydro dihydro piperidone hexose reductone; sulfonamido-phenol reducing agents such as 2,6-dichloro-4-benzensulfonamidophenol, and p-benzenesulfonamidophenol; 2-phenylindane-1,3-dione and the like; chromans such as 2,2-dimethyl-7-t-butyl-6-hydroxychroman; 1,4-dihydro-pyridines such as 2,6-dimethoxy-3,5-dicarbetoxy-1,4-dihydropyridine; bisphenols e.g., bis(2-hydroxy-3-t-butyl-5-methylphenyl)methane, 2,2-bis(4-hydroxy-3-methylphenyl)propane, 4,4-ethylidenebis(2-tert-butyl-6-methylphenol), and 2,2-bis(3,5-dimethyl-4-hydroxyphenyl)propane; ascorbic acid derivatives, e.g., 1-ascorbylpalmitate, ascorbylstearate and unsaturated aldehydes and ketones, such as benzyl and diacetyl; 3-pyrazolidones and certain indane-1,3-diones.

The literature discloses additives, "toners", which improve the image.

Toner materials may be present, for example, in amounts from 0.1 to 10 percent by weight of all silver bearing components. Toners are well known materials in the photothermographic art as shown in U.S. Pat. Nos. 3,080,254; 3,847,612 and 4,123,282.

Examples of toners include phthalimide and N-hydroxyphthalimide; cyclic imides such as succinimide, pyrazoline-5-ones, and a quinazolinone, 3-phenyl-2-pyrazoline-5-one, 1-phenylurazole, quinazoline, and 2,4-thiazolidinedione; naphthalimides, e.g., N-hydroxy-1,8-naphthalimide; cobalt complexes, e.g., cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryl dicarboximides, e.g. (N-dimethylaminomethyl)phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene bis(1-carbamoyl-3,5-dimethylpyrazole), 1,8-(3,6-diazaoctane)bis(isothiuronium trifluoroacetate) and 2-(tribromomethylsulfonyl)benzothiazole); and merocyanine dyes such as 3-ethyl-5[(3-ethyl-2-benzothiazolinylidene)-1-methylethylidene]-2-thio-2,4-oxazolidinedione; phthalazinone, phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus phthalic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimidine, 2-hydroxy-4-aminopyrimidine, and azauracil, and tetrazapentalene derivatives, e.g, 3,6-dimercapto-1,4diphenyl-1H,4H-2,3a,5,6a-tetrazapentalene, and 1,4-di(o-chlorophenyl)3,6-dimercapto-1H,4H-2,3a,5,6a-tetrazapentalene.

A number of methods have been proposed for obtaining color images with dry silver systems. Such methods include incorporated coupler materials, e.g., a combination of silver benzotriazole, well known magenta, yellow and cyan dye-forming couplers, aminophenol developing agents, a base release agent such as guanidinium trichloroacetate, and silver bromide in poly(vinyl butyral); a combination of silver bromoiodide, sulfonamidophenol reducing agent, silver behenate, poly(vinyl butyral), an amine such as n-octadecylamine and "2-equivalent" or "4-equivalent" cyan, magenta or yellow dye -forming couplers; incorporating leuco dye bases which oxidize to form a dye image, e.g., the leuco forms of Malachite Green, Crystal Violet and pararosaniline; a combination of in situ silver halide, silver behenate, 3-methyl-1-phenylpyrazolone and N,N'-dimethyl-p-phenylenediamine hydrochloride; incorporating phenolic leuco dye reducing agents such as 2-(3,5-di-tert-butyl-4-hydroxyphenyl)-4,5-diphenylimidazole, and bis(3,5-di-tert-butyl-4-hydroxyphenyl)phenylmethane; incorporating azomethine dyes or azo dye reducing agents; a silver dye bleach process, e.g., an element comprising silver behenate, behenic acid, poly(vinyl butyral), poly(vinyl-butyral)peptized silver bromoiodide emulsion, 2,6-dichloro-4-benzene sulfonamido phenol, 1,8-(3,6-diazaoctane)bisisothiuronium-p-toluene sulfonate and an azo dye, was exposed and heat processed to obtain a negative silver image with a uniform distribution of dye, which was laminated to an acid activator sheet comprising polyacrylic acid, thiourea and p-toluene sulfonic acid and heated to obtain well defined positive dye images; and incorporating amines such as aminoacetanilide (yellow dye-forming), 3,3'-dimethoxybenzidine (blue dye-forming) or sulfanilanilide (magenta dye forming) which react with the oxidized form of incorporated reducing agents such as 2,6-dichloro-4-benzenesulfonamidophenol to form dye images. Neutral dye images can be obtained by the addition of amines such as behenylamine and p-anisidine.

Leuco dye oxidation in such silver halide systems is disclosed in U.S. Pat. Nos. 4,021,240, 4,374,821, 4,460,681 and 4,883,747.

Silver halide emulsions containing the stabilizers of this invention can be protected further against the additional production of fog and can be stabilized against loss of sensitivity during keeping. Suitable anti-foggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen U.S. Pat. No. 2,728,663; the urazoles described in Anderson, U.S. Pat. No. 3,287,135; the sulfocatechols described in Kennard, U.S. Pat. No. 3,235,652; the oximes described in Carrol et. al., British Patent No. 623,448; nitron; nitroindazoles; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Stabilized emulsions of the invention can contain plasticizers and lubricants such as polyalcohols, e.g., glycerin and diols of the type described in Milton, U.S. Pat. No. 2,960,404; fatty acids or esters such as those described in Robins, U.S. Pat. No. 2,588,765 and Duane, U.S. Pat. No. 3,121,060; and silicone resins such as those described in DuPont British Patent No. 955,061.

The photothermographic elements can include image dye stabilizers. Such image dye stabilizers are illustrated by U.K. Patent No. 1,326,889; Lestina et al. U.S. Pat. Nos. 3,432,300 and 3,698,909; Stern et al. U.S. Pat. No. 3,574,627; Brannock et al. U.S. Pat. No. 3,573,050; Arai et al. U.S. Pat. No. 3,764,337 and Smith et al. U.S. Pat. No. 4,042,394.

Photothermographic elements containing emulsion layers stabilized according to the present invention can be used in photographic elements which contain light absorbing materials and filter dyes such as those described in Sawdey, U.S. Pat. No. 3,253,921; Gaspar U.S. Pat. No. 2,274,782; Carroll et al., U.S. Pat. No. 2,527,583 and Van Campen, U.S. Pat. No. 2,956,879. If desired, the dyes can be mordanted, for example, as described in Milton and Jones, U.S. Pat. No. 3,282,699.

Photothermographic elements containing emulsion layers stabilized as described herein can contain matting agents such as starch, titanium dioxide, zinc oxide, silica, polymeric beads including beads of the type described in Jelley et al., U.S. Pat. No. 2,992,101 and Lynn, U.S. Pat. No. 2,701,245.

Emulsions stabilized in accordance with this invention can be used in photothermographic elements which contain antistatic or conducting layers, such as layers that comprise soluble salts, e.g., nitrates, etc., evaporated metal layers, ionic polymers such as those described in Minsk, U.S. Pat. Nos. 2,861,056, and 3,206,312 or insoluble inorganic salts such as those described in Trevoy, U.S. Pat. No. 3,428,451.

The binder may be selected from any of the well-known natural or synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic silver-containing polymer is polyvinyl butyral, but ethyl cellulose, methacrylate copolymers, maleic anhydride ester copolymers, polystyrene, and butadiene-styrene copolymers may be used.

Optionally these polymers may be used in combination of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Photothermographic emulsions containing antihalation materials of the invention can be coated on a wide variety of supports. Typical supports include polyester film, "subbed" polyester film, poly(ethylene terephthalate)film, cellulose nitrate film, cellulose ester film, poly(vinyl acetal) film, polycarbonate film and related or resinous materials, as well as glass, paper, metal, and the like. Typically, a flexible support is employed, especially a paper support, which can be partially acetylated or coated with baryta and/or an alpha-olefin polymer, particularly a polymer of an alpha-olefin containing 2 to 4 carbon atoms such as polyethylene, polypropylene, ethylenebutene copolymers and the like.

The substrate with backside resistive heating layer may also be used in color photothermographic imaging systems such as shown in U.S. Pat. Nos. 4,460,681 and 4,374,921.

Photothermographic emulsions of this invention can be coated by various coating procedures including dip coating, air knife coating, curtain coating, or extrusion coating using hoppers of the type described in Benguin, U.S. Pat. No. 2,681,294. If desired, two or more layers may be coated simultaneously by the procedures described in Russell, U.S. Pat. No. 2,761,791 and Wynn, British Patent No. 837,095.

The present invention will now be illustrated in detail in reference to the following examples, but the embodiment of the present invention is not limited thereto.

EXAMPLES

In the following examples, dyes having two or three methoxy substituents on a common nucleus are shown. The common nucleus is

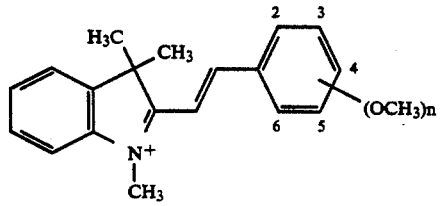

and the dyes in experimental examples will be defined by the position of attachment of the methoxy groups to the phenyl ring such as "2,4,5" indicating a 2,4,5-trimethoxyphenyl group. The anion in all cases was perfluoro(ethylcyclohexanesulfonate). This anion is also referred to herein as "PECHS."

EXAMPLES 1-12

Typical heat bleachable antihalation formulations were prepared as described below and in Table II.

Solution A: A solution of Eastman cellulose acetate butyrate (CAB 381-20), Goodyear polyester (PE-200), 2-butanone, toluene, and 4-methyl-2-pentanone was prepared. To this was added p-nitrophenylsulfonylacetic acid where indicated (as in Experiments No. 7-12).

Solution B: A solution of methoxy substituted styryl dye in methanol was prepared.

Solution C: A solution of guanidine p-nitrophenylsulfonylacetate salt (thermal amine generator), methanol, dimethylformamide was prepared.

The resulting polymer, dye, and amine generator solutions were combined and mixed thoroughly and coated onto a polyester base using a knife coater. The wet coating thickness was 3 mil (76 μm). The coating was dried 4 minutes at 180° F. (82° C.). The base can be a clear or white opaque polyester. On opaque polyester the following absorbances were obtained using a Hitachi reflectance mode spectrometer. Examples 1-6 contained no acid stabilizer. Examples 7-12 contained an acid stabilizer.

TABLE I

| Ext. No. | Dye | Dmax | wavelength nm |
|---|---|---|---|
| | Examples 1-6 (Without Acid) | | |
| 1 | 3,4,5- | 0.52 | 425 |
| 2 | 2,4- | 0.78 | 450 |
| 3 | 2,3- | 0.40 | 390 |
| 4 | 3,4- | 0.72 | 445 |
| 5 | 2,4,5- | 0.77 | 487 |
| 6 | 2,4,6- | 1.09 | 460 |
| | Examples 7-12 (With Acid) | | |
| 7 | 3,4,5- | 0.90 | 425 |
| 8 | 2,4- | 1.48 | 450 |
| 9 | 2,3- | 0.90 | 390 |
| 10 | 3,4- | 1.20 | 445 |
| 11 | 2,4,5- | 1.10 | 487 |
| 12 | 2,4,6- | 1.40 | 460 |

The constructions were run through a 3M Model 9014 Dry Silver Processor. The temperature was 265° F. (165° C.) and dwell time was 10 seconds. All dye constructions completely bleached to an absorbance of 0.0. The results, shown below, indicate that acid-containing constructions have a higher $D_{max}$ than the non-acid-containing constructions. This is due to improved "pot life" and resistance to bleaching during oven drying.

Aging studies were carried out by storing samples at 80° F. (27° C.) and 80% humidity and periodically measuring absorbance. Reflectance measurements of absorbance of samples of Examples 2 and 8 gave the following results:

| Time | Example 2 Absorbance | Example 8 Absorbance |
|---|---|---|
| 0 | 0.78 | 1.48 |
| 1 week | 0.27 | |
| 2 weeks | 0.06 | 0.36 |

TABLE II

Typical Antihalation Formulation

| Material | Without Acid wt. g | With Acid wt. g |
|---|---|---|
| Solution A: | | |
| Eastman Cellulose Acetate Butyrate (CAB) | 0.4420 | 0.4420 |
| Goodyear PE-200 Polyester | 0.0059 | 0.0059 |
| 2-butanone | 2.9637 | 2.9637 |
| Toluene | 1.4410 | 1.4410 |
| 4-methyl-2-pentanone | 0.4830 | 0.4830 |
| p-nitrophenylsulfonyl acetic acid (Acid) for dimethoxy dyes | 0.0000 | 0.0121 |
| p-nitrophenylsulfonyl acetic acid (Acid) for trimethoxy dyes | 0.0000 | 0.0126 |
| Solution B: | | |
| Dye | 0.0434 | 0.0434 |
| Methanol | 1.5500 | 1.5500 |
| Solution C: | | |
| Guanidine p-nitrophenylsulfonyl acetic acid salt - $C_1A_1$ - (for dimethoxy dyes) | 0.0584 | 0.0584 |
| Guanidine p-nitrophenylsulfonyl acetic acid salt - $C_1A_1$ - (for trimethoxy dyes) | 0.0606 | 0.0606 |
| Methanol | 2.4000 | 2.4000 |
| Dimethylformamide (DMF) | 2.4000 | 2.4000 |

EXAMPLE 13

Heat bleachable coatings with proportions similar to those of Example 2 may be prepared as follows:

A solution of Eastman cellulose acetate butyrate (CAB 381-20), Goodyear polyester (PE-200), 2-butanone, toluene, and 4-methyl-2-pentanone is prepared. To this is added p-nitrophenylsulfonylacetic acid.

A solution of methoxy substituted styryl dye in methanol is prepared.

A solution of thermal nucleophile generator salt (thermal amine generator) $C_1$-$C_5$; $A_1$-$A_6$, methanol and dimethylformamide, is prepared.

The resulting polymer, dye, and amine generator solutions are combined and mixed thoroughly and coated onto a polyester substrate using a knife coater. The wet coating thickness is 3 mil (76 μm). The coating is dried 4 minutes at 180° F. (82° C.). The base is a clear or white opaque polyester.

The constructions are run through a 3M Model 9014 Dry Silver Processor. The temperature is 265° F. (165° C.) and dwell time is 10 seconds. All dye constructions would bleach.

EXAMPLES 14 AND 15

These Examples describe the use of the coating of Example 8 as potential thermographic medium. The coating prepared as described in Experiment 8 had a strong yellow color.

In order to test the construction as a thermographic imaging material, the material was overcoated with 5% cellulose acetate solution in acetone (50 μm wet thickness). This coating prevented sticking and toner pick-off from an original.

This coating was found to produce a pleasing negative clear-on-yellow transparent copy from printed text using a 3M Thermofax TM copier set at ⅔ maximum setting.

A sheet of the yellow coating prepared in Experiment 8 was also evaluated as a positive thermographic imaging material. An electronic signal was used to drive the thermal head of an Oyo Geo Space GS-612 Thermal Plotter to bleach the construction in the background areas. A positive yellow image on a clear background resulted.

TABLE III

Thermal Base Generating Salts

Cations $C_1$

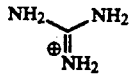

$C_2$

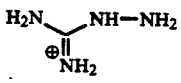

$C_3$

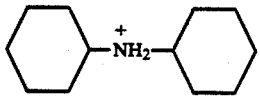

$C_4$

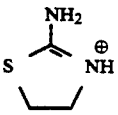

$C_5$

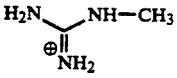

Anions $A_1$

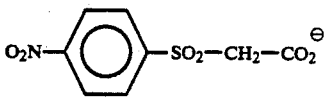

$A_2$

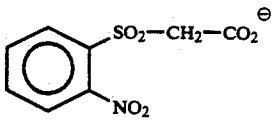

$A_3$

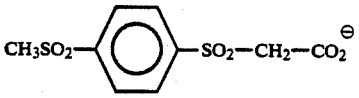

$A_4$ $Cl_3CCO_2^{\ominus}$ $A_5$

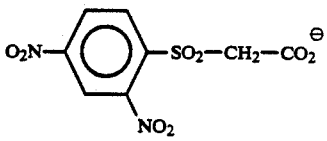

$A_6$

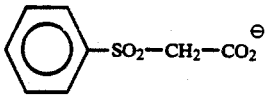

We claim:

1. A thermal-dye-bleach combination comprising a thermal nucleophile-generating agent in association with a styryl dye having a nucleus of general formula (I):

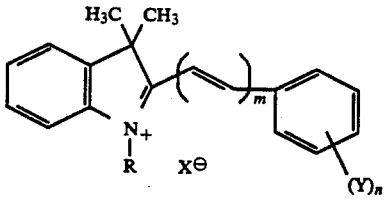

representing the nucleus of a styryl dye in which

R=alkyl group of 1 to 20 carbon atoms,

Y=alkoxy of 1 to 10 carbon atoms, m=1 or 2, n=1, 2, or 3, and $X^{\ominus}$=an anion.

2. A thermal-dye-bleach combination as claimed in claim 1 in which the thermal nucleophile-generating agent is a thermal amine-release agent.

3. A thermal-dye-bleach combination as claimed in claim 2 in which the thermal amine-release agent comprises an amine salt of an organic acid which liberates one or more free amine groups upon thermal decomposition.

4. A thermal-dye-bleach combination as claimed in claim 3 in which the thermal-amine release agent comprises a thermal amine-generating salt comprising a cation selected from C1 to C5 in combination with an anion selected from A1 to A6:

Cation $C_1$

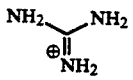

$C_2$

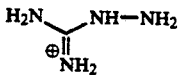

$C_3$

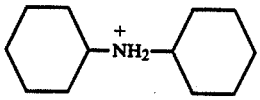

$C_4$

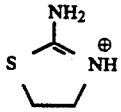

$C_5$

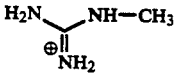

Anions $A_1$

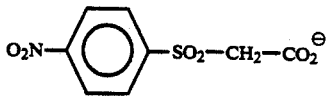

$A_2$

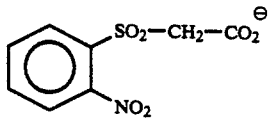

$A_3$

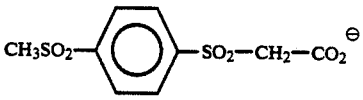

-continued

A4 $Cl_3CCO_2^{\ominus}$

A5

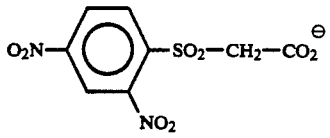

A6

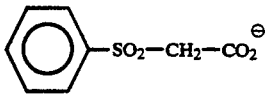

5. A thermal-dye-bleach combination as claimed in claim 1 in the form of a photothermographic element comprising a support bearing an electromagnetic radiation sensitive photographic silver halide material, the element comprising as an antihalation or acutance agent the thermal nucleophile-generating agent and styryl dye.

6. A thermal-dye-bleach combination as claimed in claim 5 in which the silver halide is primarily ultraviolet radiation sensitive.

7. A thermal-dye-bleach combination as claimed in claim 6 in which the antihalation layer contains the styryl dye in an amount to provide a transmission optical density of at least 0.1 at the λ max of the dye.

8. A thermal-dye-bleach combination as claimed in claim 7 in which the styryl dye is present in an amount in the range from 0.1 to 1.0 mg/dm$^2$.

9. A thermal-dye-bleach combination as claimed claim 8 in which the photographic silver halide material is a photothermographic medium comprising one or two layers comprising silver halide in catalytic proximity to a light-insensitive silver salt, a binder, and a reducing agent for silver ion.

10. A thermal-dye-bleach combination as claimed in claim 2 which further comprises an acid.

11. A thermal-dye-bleach combination as claimed in claim 10 in which the acid comprises a phenylsulfonyl acetic acid.

12. A thermal-dye-bleach combination as claimed in claim 4 which further comprises an acid.

13. A thermal-dye bleach combination as claimed in claim 12 in which the acid is the product derived from acidification of the anions selected from $A_1$ to $A_6$.

14. A thermal-dye-bleach combination as claimed in claim 5 which further comprises an acid.

15. A thermal-dye-bleach combination as claimed in claim 14 in which the acid comprises a phenylsulfonyl acetic acid.

16. A thermal-dye-bleach combination as claimed in claim 14 in which the thermal-amine release agent comprises a thermal amine-generating salt comprising a cation selected from C1 to C5 in combination with an anion selected from $A_1$ to $A_6$:

Cation $C_1$

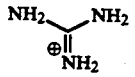

$C_2$

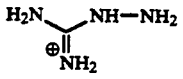

$C_3$

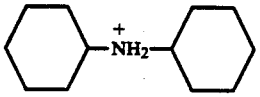

$C_4$

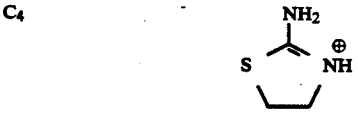

$C_5$

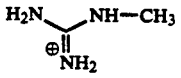

Anions $A_1$

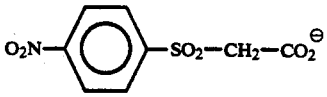

$A_2$

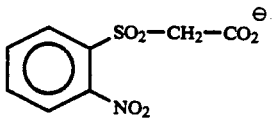

$A_3$

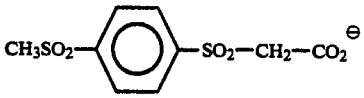

$A_4$ $Cl_3CCO_2^{\ominus}$ $A_5$

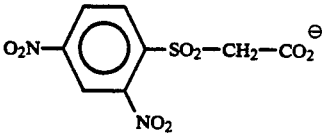

$A_6$

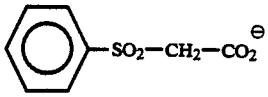

17. A thermal-dye bleach combination as claimed in claim 16 in which the acid is the product derived from acidification of the anions selected from $A_1$ to $A_6$.

* * * * *

UNITED STATES PATENT AND TRADEMARK OFFICE

CERTIFICATE OF CORRECTION

PATENT NO. : 5,258,274

DATED : November 2, 1993

INVENTOR(S) : Helland et al.

It is certified that error appears in the above-indentified patent and that said Letters Patent is hereby corrected as shown below:

Column 2, line 57, delete "mater ."
and insert --materials,--.
Column 6, line 5, delete "pages 49 to 169."
and insert --pages 149 to 169.--.
Column 11, line 32, delete "Ext. No."
and insert --Expt. No.--.

Signed and Sealed this

Twenty-seventh Day of December, 1994

Bruce Lehman

*Attest:*

BRUCE LEHMAN

*Attesting Officer*

*Commissioner of Patents and Trademarks*